US008062196B1

(12) United States Patent
Khubani

(10) Patent No.: US 8,062,196 B1
(45) Date of Patent: Nov. 22, 2011

(54) ABDOMINAL EXERCISE APPARATUS

(75) Inventor: Ajit Khubani, Saddle River, NJ (US)

(73) Assignee: International Edge Inc., Fairfield, NJ (US)

( * ) Notice: Subject to any disclaimer, the term of this patent is extended or adjusted under 35 U.S.C. 154(b) by 0 days.

(21) Appl. No.: 12/804,554

(22) Filed: Jul. 23, 2010

(51) Int. Cl.
*A63B 26/00* (2006.01)
*A63B 21/068* (2006.01)

(52) U.S. Cl. ..... 482/140; 482/95

(58) Field of Classification Search ..... 482/140–142, 482/148, 95–96, 72
See application file for complete search history.

(56) References Cited

U.S. PATENT DOCUMENTS

| | | | | |
|---|---|---|---|---|
| 6,565,489 | B2 | 5/2003 | Ho et al. | |
| D476,045 | S | 6/2003 | Casey et al. | |
| 6,602,171 | B1 * | 8/2003 | Tsen et al. | 482/140 |
| 7,329,213 | B1 | 2/2008 | Farley | |
| 7,344,486 | B2 * | 3/2008 | Casey et al. | 482/140 |
| 7,604,580 | B2 | 10/2009 | Lamarque | |
| 7,618,357 | B2 | 11/2009 | Dalebout et al. | |
| 7,625,323 | B1 | 12/2009 | Lin | |
| 7,713,181 | B1 | 5/2010 | Durham | |
| 2003/0144118 | A1 * | 7/2003 | Tsen et al. | 482/130 |
| 2004/0067831 | A1 * | 4/2004 | Hou | 482/140 |
| 2006/0166799 | A1 * | 7/2006 | Boland et al. | 482/140 |
| 2007/0129225 | A1 | 6/2007 | Hammer | |
| 2007/0149373 | A1 | 6/2007 | Dalebout et al. | |
| 2007/0259762 | A1 * | 11/2007 | Ho | 482/142 |
| 2009/0305855 | A1 | 12/2009 | Terrell | |

OTHER PUBLICATIONS

"AB Circle Pro—Lose Your Love Handles!", 1 page, Oct. 1, 2009.

* cited by examiner

*Primary Examiner* — Fenn Mathew
(74) *Attorney, Agent, or Firm* — Cooper & Dunham LLP

(57) ABSTRACT

An abdominal exercise apparatus having a seat attached to a frame, a swing bar rotatably attached to the frame about a swing bar axis, a back rest rotatably attached to the swing bar about a back rest axis which is substantially perpendicular to the swing bar axis, and a handle bar rotatably attached to the swing bar about a handle bar axis which is substantially parallel to the back rest axis; and a method for performing an abdominal exercise includes sitting on the seat, laying one's back against the back rest and gripping the handle bar while twisting one's torso about one's hips to cause the swing bar to rotate relative to the frame about the swing bar axis and rotating the handle bar about the back rest axis to cause a rotation of the back rest about the back rest axis.

16 Claims, 5 Drawing Sheets

ABDOMINAL EXERCISE APPARATUS

TECHNICAL FIELD

This invention relates to an apparatus and method for aiding exercise activities of a human, including muscle development, toning, and strength training. Abdominal muscle development is particularly compatible with the present exercise apparatus.

DESCRIPTION OF RELATED ART

Exercise aids have long been used to aid in the strengthening and toning of various muscle groups of the body. With particular reference to the abdominal muscles, exercise aids have been devised which generally involve controlling or resisting the bending of the lower back, a motion generally replicating that of a traditional sit-up. Some abdominal exercise aids provide a combination of a seat, back or head rests and/or some form of variable resistance to modify the traditional sit-up motion. One such example is found in U.S. Pat. No. 7,344,486 which is hereby incorporated by this reference in its entirety.

Users typically desire to target their exercise to various combinations of abdominal muscles, for example, the oblique or lateral abdominal muscles are of particular interest to exercisers. Among the approaches employed by exercise aids to target these muscles are devices which induce a twisting of the user's spine about its longitudinal axis during a sit-up. This twisting motion provides resistance to the muscles of the user's abdomen, torso, hips, etcetera. However, these movements often involve a twisting of the spine that may not be isolated to the muscles of the specific region targeted, and may also cause pain in users with a history of back pain or injury. In particular, an exercise aid is needed which specifically targets muscles in the oblique and lateral abdominal region while helping to reduce spinal twisting and other movements superfluous to the contraction of the targeted muscles.

SUMMARY

This invention provides apparatuses and methods for exercising abdominal muscles, and particularly lateral or oblique abdominal muscles, by allowing users to twist their torsos about their hips while restricting any twisting of the shoulders or spine.

In one example, an abdominal exercise apparatus comprises a frame, a seat attached to the frame, a swing bar rotatably attached to the frame such that the swing bar is rotatable relative to the frame about a swing bar axis, a back rest rotatably attached to the swing bar about a back rest axis which is substantially perpendicular to the swing bar axis, and a handle bar rotatably attached to the swing bar about a handle bar axis which is substantially parallel to the back rest axis.

In another example, a rotation of the handle bar about the handle bar axis causes a rotation of the back rest about the back rest axis.

In yet another example, the swing bar axis is oriented substantially parallel to a direction of gravity.

In a further example, the swing bar further comprises an auxiliary support element configured to contact the frame.

In still a further example, the apparatus may include swing bar rotation stops configured to limit a rotation of the swing bar about the swing bar axis to a predefined angular range.

An exemplary method for performing an abdominal exercise comprises the steps of sitting on a seat attached to a frame, laying at least one's back against a back rest, the back rest being rotatably attached to a swing bar about a back rest axis, the swing bar being rotatably attached to the frame about a swing bar axis oriented substantially perpendicular to the back rest axis, gripping a handle bar, the handle bar being rotatably attached to the swing bar at a handle bar axis, the handle bar axis being parallel to the back rest axis, twisting one's torso about one's hips to cause a rotation of the swing bar relative to the frame about the swing bar axis, and rotating the handle bar about the handle bar axis and to cause a rotation of the back rest about the back rest axis.

BRIEF DESCRIPTION OF THE DRAWINGS

The above mentioned and other aspects, features and advantages can be more readily understood from the following detailed description with reference to the accompanying drawings wherein.

DETAILED DESCRIPTION

Abdominal exercise apparatuses and methods for using the same are described herein, with reference to examples and exemplary embodiments. Specific terminology is employed in describing examples and exemplary embodiments. However, the disclosure of this patent specification is not intended to be limited to the specific terminology so selected and it is to be understood that each specific element includes all technical equivalents that operate in a similar manner.

Figure 1:
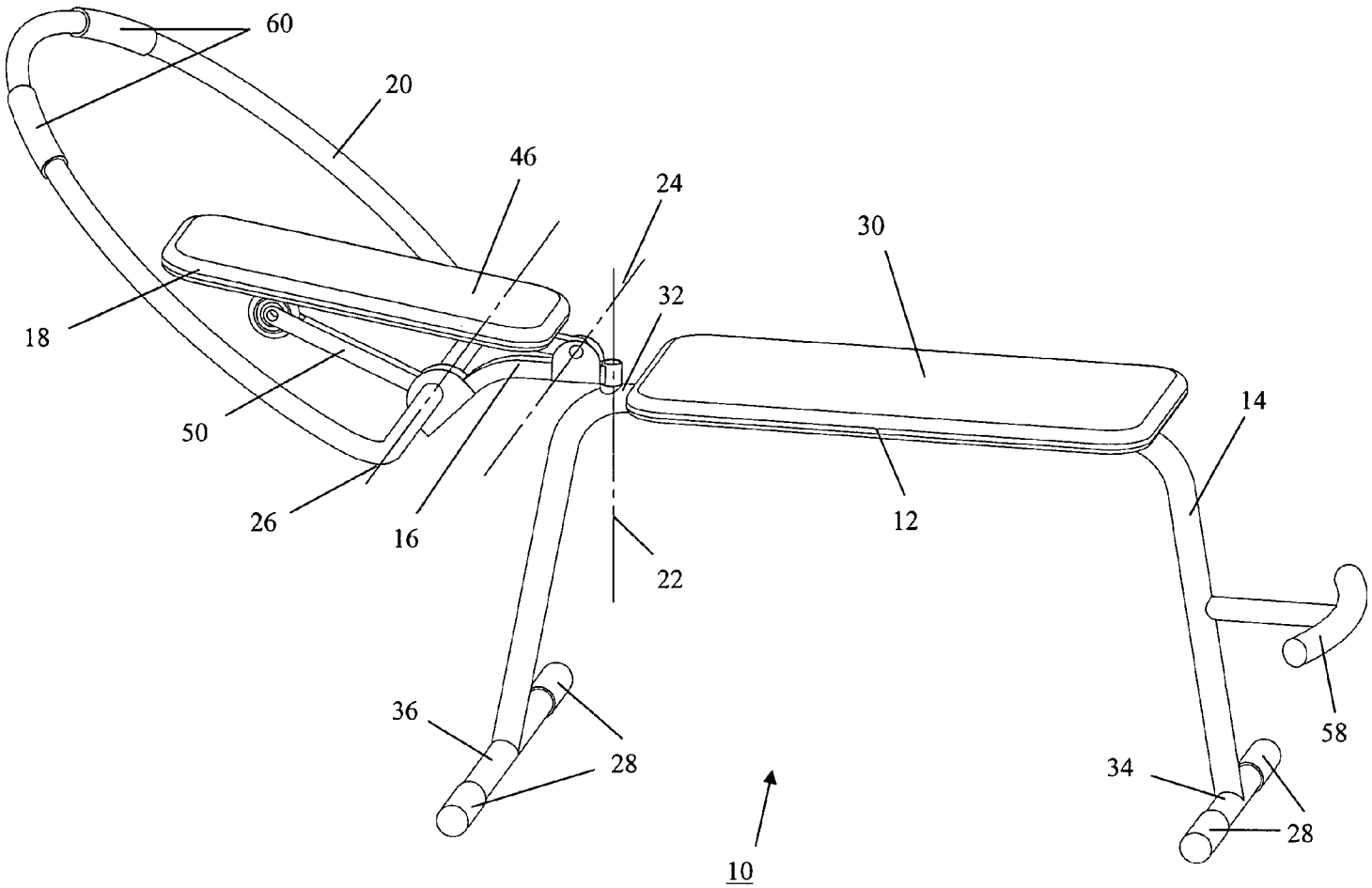
FIG. 1 shows a perspective view of an exemplary abdominal exercise apparatus according to an aspect of the present invention.

In one exemplary embodiment, shown in FIG. 1, an abdominal exercise apparatus 10 includes a seat 12, a frame 14, a swing bar 16, a back rest 18 and a handle bar 20. The swing bar 16 is rotatably attached to the frame 14 such that the swing bar 16 is rotatable relative to the frame 14 about a swing bar axis 22. The back rest 18 is rotatably attached to the swing bar 16 about a back rest axis 24 which is substantially perpendicular to the swing bar axis 22. The handle bar 20 is rotatably attached to the swing bar 16 about a handle bar axis 26 which is substantially parallel to the back rest axis 24. Such elements and their relative rotatable attachments are described in more detail below.

In one example, a seat 12 is attached to a frame 14. The frame 14 is generally configured to remain fixed relative to a floor during use. To aid in achieving this goal, friction enhancing elements 28 such as rubber pads or the like may be added to the frame to grip the floor more securely and/or to protect the floor from scratches. When not in use, however, the frame 14 and seat 12, along with the other elements, are configured to be easily movable by a user to a storage location. Such storage features are described in greater detail below.

The seat 12 may be formed from a rigid or semi-rigid material such as metal, plastic, wood, etcetera. or may comprise a plurality of materials configured as a composite structure. In one example, a seat is comprised of a rigid seat base, a layer of compliant foam or batting, and a fabric, vinyl or similar sheet material positioned over the compliant material and secured to the rigid seat base, sandwiching the compliant material between the rigid seat base and the sheet material. The seat 12, in one embodiment, is generally oriented with its seat plane 30 oriented perpendicular to a direction of gravity, or, in other words, parallel to a plane of the floor. The term "seat plane" is used throughout this disclosure to refer to a plane of the main user supporting surface of the seat or, if no such singular plane exists, to a plane approximating an average of the user supporting surfaces of the seat.

The frame 14 attached to the seat 12 may be constructed from any suitable rigid material. In one example, the frame 14 is constructed of steel tubing having a hollow square profile. The frame 14 may or may not be configured to contact the floor, for example, in the case described above in which the apparatus includes one or more friction enhancing elements 28.

In one example, the frame 14 includes a central frame element 32 oriented in substantially one plane which is oriented perpendicular to the floor and bisects the seat 12 into substantially equally sized left and right portions (from the perspective of a seated user with their back contacting the back rest). This plane is referred to herein as the "seat bisecting plane".

The frame 14 may also include first 34 and second 36 frame stabilizing members configured to prevent the apparatus 10 from tipping during use. Throughout this description, the term "first frame stabilizing member" is used to refer to a frame stabilizing member 34 at an end of the frame 14 closer to the feet of a seated user with their back contacting the back rest 18. Correspondingly, the term "second frame stabilizing member" is used herein to refer to a frame stabilizing member 36 located at an end of the frame 14 opposite the first frame stabilizing member 34. The first 34 and second 36 frame stabilizing members may be configured identically or may be configured differently. In one example, shown in FIGS. 1 and 2, the second frame stabilizing member 36 symmetrically extends further than the first frame stabilizing member 34 from the seat bisecting plane.

The frame 14 may also include an optional leg contacting member 58. The leg contacting member 58 may be configured to restrain a user's feet or ankles at a position close to the frame 14 or first frame stabilizing member 34 such that a user may push against the leg contacting member 58 when performing a sit-up. Such leg contacting member 58 may be configured to allow adjustment, such as in a direction towards or away from the floor and/or in a direction towards or away from the seat 12 in a direction parallel to the floor. Such adjustments may be made, for example, by providing an array of complementary holes in the frame 14 and contacting member 58 configured to accept a fixing pin or similar component. As another example, the leg contacting member 58 may be configured to be adjusted by fixing a rotation of the leg contacting member 58 relative to the frame 14 at a desired rotation angle. The rotation angle may be continuously adjustable or may be configured to be fixed at any of a predetermined number of discretely arrayed rotation angles.

Figure 2:
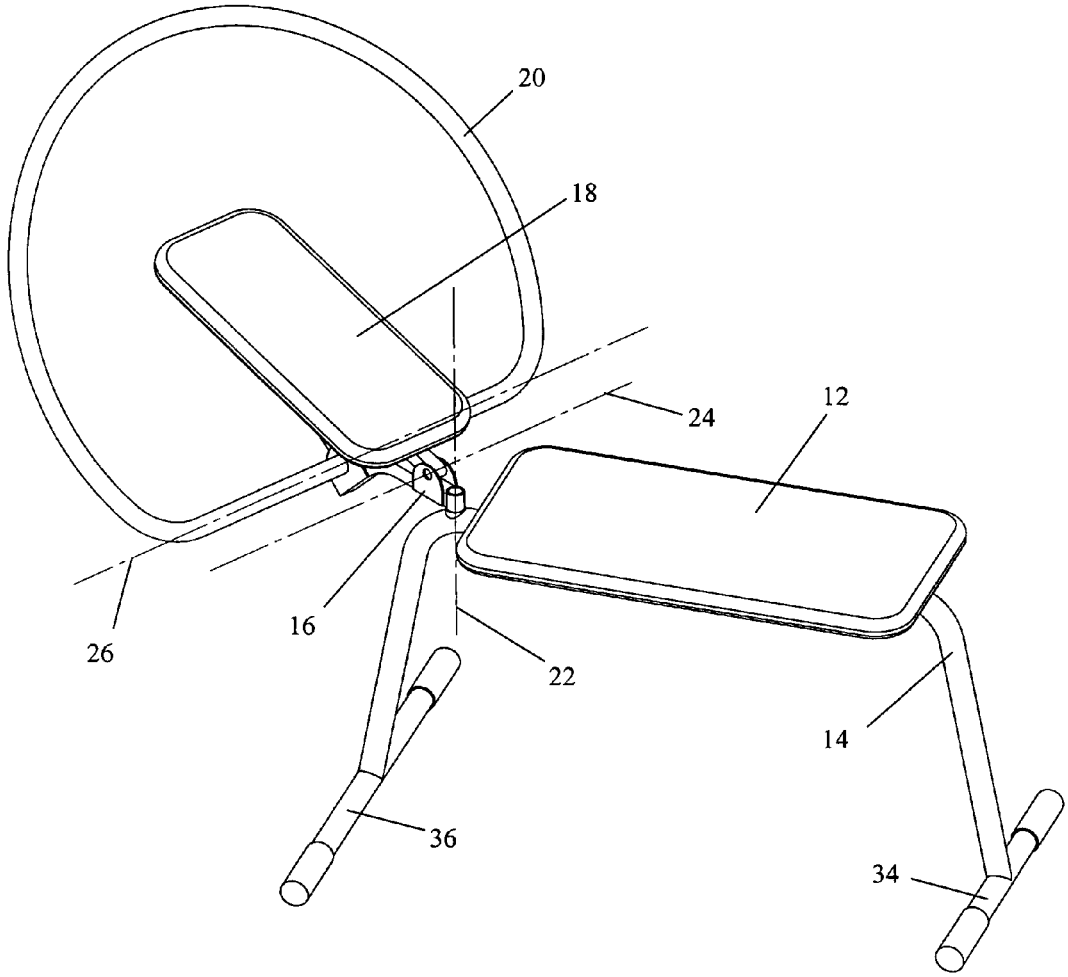
FIG. 2 shows another perspective view of an exemplary abdominal exercise apparatus according to another aspect of the present invention.

The swing bar 16 is configured to rotate relative to the frame 14 about the swing bar axis 22. FIG. 1 shows the swing bar 16 rotated to be substantially parallel to the seat bisecting plane. FIG. 2 shows the swing bar 16 rotated relative to the frame 14 by an arbitrary angle. The location of the swing bar axis 22 relative to the seat 12 and frame 14 is highly customizable. To provide a balanced workout of the abdominal muscles, however, the swing bar axis 22 is preferably oriented along the seat bisecting plane. For example, the swing bar axis 22 may intersect a central frame element 32.

In one example, the swing bar axis 22 may be oriented along the seat bisecting plane and perpendicularly to the seat plane 30, or, in other words, generally parallel to a direction of gravity. The swing bar axis 22 may be defined by a bearing, bore, boss or any other mechanical feature known in the art to restrict relative movement to a rotational motion about an axis.

Figure 5:
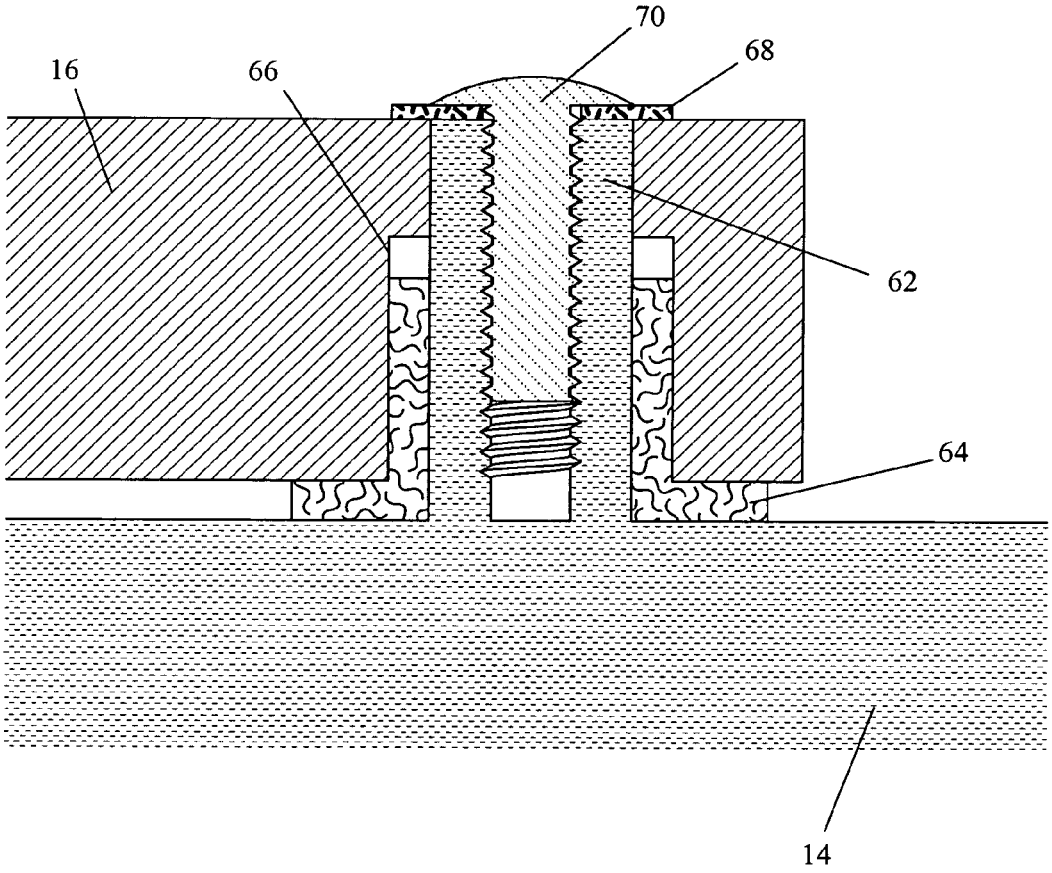
FIG. 5 shows another detailed perspective view of an exemplary abdominal exercise apparatus according to another aspect of the present invention.

In one example, shown in FIG. 5, the frame 14 is provided with an internally threaded round boss 62 fixed to a top surface of the frame 14 having its axis oriented parallel to a direction of gravity. A plain flanged bearing 64 formed of friction reducing material is placed over the round boss's outer circumferential surface with its flange oriented towards the frame 14. A round bore 66 fixed to the swing bar 16 is fitted over the round boss 62 and plain bearing 64, supported by the flange of the plain bearing 64, and is held in place by a washer 68 and threaded fastener 70 threaded into the internally threaded portion of the round boss 62. In this example, the outer circumferential surface of the round boss 62 of the frame 14 and the inner circumferential surface of the round bore 66 of the swing bar 16 define the swing bar axis 22.

In another example, the swing bar axis 22 may be oriented along the seat bisecting plane but inclined at some angle from the direction of gravity. In this example, a plane of the rotational motion of the swing bar 16 about the seat and frame will not be parallel to the seat plane 30, as in the above example, but will instead be inclined at some angle relative to the seat plane 30. In one such example, the swing bar axis 22 may be inclined to extend up from the floor and away from the first base stabilizing member 34 in order to increase a resistance to rotating the swing bar 16 to either side of the seat bisecting plane.

In a similar, but opposite example, the swing bar axis 22 may be oriented along the seat bisecting plane but inclined at an angle towards the user's feet as the axis extends up from the floor. In this configuration, the swing bar 16 would be biased to swing away from the seat bisecting plane, requiring fine muscle adjustment by a user to keep the swing bar 16 parallel to the seat bisecting plane or in another desired angular relationship to the seat 12 and frame 16 while rotating the handle bar 20 or back rest 18.

The location of an intersection of the swing bar axis 22 and the seat plane 30 is also highly customizable. While such intersection point is preferably located along the seat bisecting plane, as discussed above, its position along the intersection of the seat bisecting plane and the seat plane is not substantially limited. In one example, the intersection point of the swing bar axis 22 and the seat plane 30 is located beyond an end of the seat 12 on a side farthest from a user's feet. In this general position, twisting of the user's torso, which generally twists with the swing bar, is controlled to an axis extending near a junction of the user's spine and hips.

Figure 3:
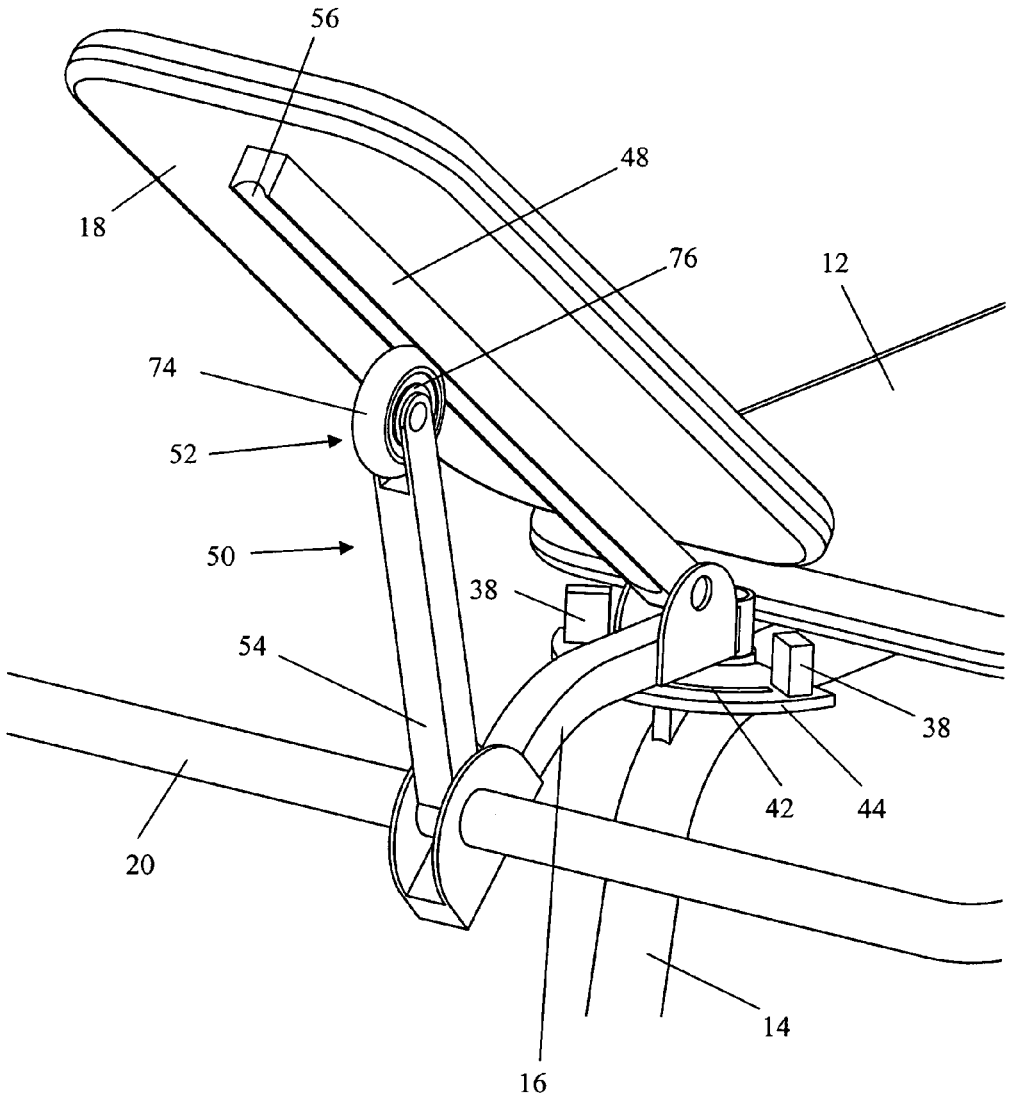
FIG. 3 shows a detailed perspective view of an exemplary abdominal exercise apparatus according to another aspect of the present invention.
Figure 4:
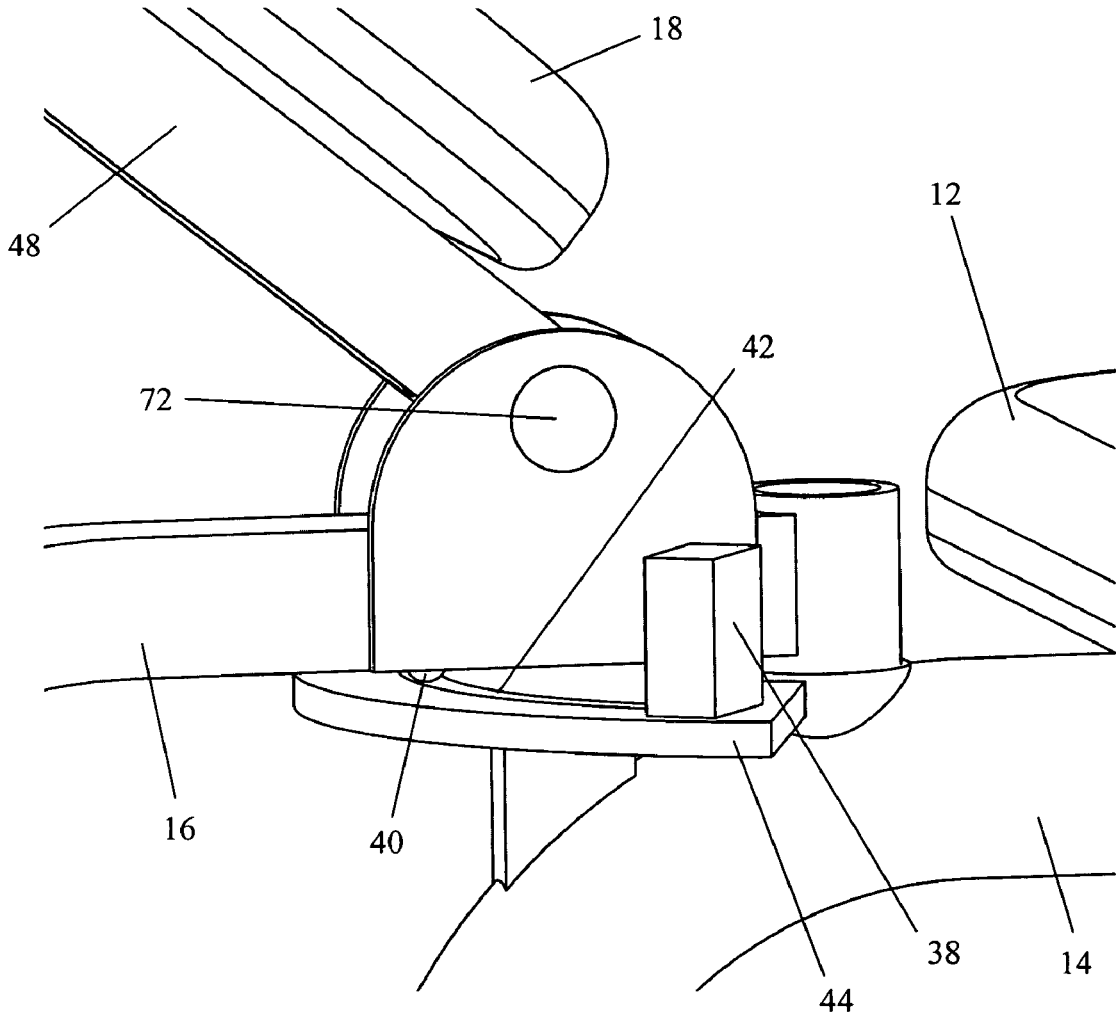
FIG. 4 shows another detailed perspective view of an exemplary abdominal exercise apparatus according to another aspect of the present invention.

Optionally, as shown in FIGS. 3 and 4, the abdominal exercise apparatus 10 may include rotation stops 38 configured to limit rotation of the swing bar 16 about the seat 12 and frame 14 to a predefined angular range. It will be recognized that the rotation stops 38 may be fixed to, for example, either the frame 14, the swing bar 16 or both. In the example shown in FIGS. 3 and 4, the rotation stops 38 are fixed to the frame 14 and are arrayed symmetrically about the seat bisecting plane and in a rotational path of the swing bar 16 such that the swing bar 16 is limited in its rotation about the swing bar axis 22 to a predefined angular range between the rotation stops 38.

The swing bar 16 may also include an auxiliary support element 40 configured to at least partially relieve stresses or forces placed on the swing bar axis 22 by the weight or force of a user. Such auxiliary support element 40 may be configured to, for example, ride along a stationary track 42 attached to the frame 14. In one such example, an auxiliary support element 40 comprises a raised surface portion, in the form of a bump or bead, for example, positioned on the underside of the swing bar 16. The bead 40 is configured to contact, and partially divert force to, a complementary track 42 provided on the frame. The complementary track my include a concave surface portion, as shown in FIGS. 3 and 4, or may comprise a flat or convex surface portion instead of or in addition to a concave surface portion. Such complementary track may, for example, be provided on a web component 44 attached to the frame 14 connecting a pair of rotation stops 38, as described above. In one example, the auxiliary support element 40 of the swing bar 16 may comprise the head of a screw, rivet, weld bead, etcetera. In such an example, friction between the complementary track 42 and the auxiliary support element 40 may be varied depending on the material and geometric characteristics of each, together with any lubricating material employed, such as oil, grease or powdered lubricant.

The swing bar axis 22 may be provided at one end of the swing bar 16. Both the back rest axis 24 and the handle bar axis 26 may be oriented generally perpendicularly to the swing bar axis 22, and thus parallel to each other. The back rest axis 24 may be located closer to the swing bar axis 22 than the handle bar axis 26 and may or may not intersect the swing bar axis 22.

The back rest 18 may be constructed in a manner similar to or different from the seat 12. In one example, the back rest 18 is constructed in a manner similar to the exemplary seat 12 described above, including a rigid back rest base, a compliant material such as foam or batting, and a sheet material securing the compliant material to the rigid back rest base. The back rest 18 may be formed with a generally planar back contact surface 46 or may be configured with a contoured back contact surface configured to accept a user's back, torso and/or head. The term "back rest plane" is used throughout this disclosure to refer to a plane of the contact surface 46 of the back rest 18 or, if no such singular plane exists, to a plane approximating an average of the user contact surfaces of the back rest 18.

The back rest 18 may include a back rest pillar 48 attached to a side opposite the back rest 18 from the user contact surface 16. The back rest pillar 48 may be constructed of one or more rigid members. Materials for the back rest pillar 48 may be similar to those mentioned above for the frame 14. In one example, the back rest pillar 48 may comprise a rigid member attached to the back rest 18 in a position generally bisecting the backrest 18. The back rest pillar 48 may provide added structural rigidity to the back rest 18 as well as a means to rotatably attach the back rest 18 to the swing bar 16.

The back rest axis 24 may be defined by any one or more mechanical elements known in the art to restrict relative movement to a rotational motion. In one example, the back rest 18 includes the back rest pillar 48 mentioned above and a cylindrical bore formed in a lower end of the back rest pillar 48, the interior circumferential surface of which together with a complementary member 72 of the swing bar 16 define the back rest axis 24. A complementary pin or similar component may be provided as the complementary member 72 to interface the back rest pillar 18 to the swing bar 16.

The handle bar 20 may comprise one or more handle bar components. The handle bar 20 is configured to rotate relative to the swing bar 16 about the handle bar axis 26. The handle bar 20 is configured to be gripped by a seated user in a position such that the user's arms are extended outwards from their body somewhat. The handle bar 20 may additionally be provided with one or more grip pads 60. The grip pads 60 may consist of a rubber, foam or like material configured to increase friction and/or comfort between a user's hands and the handle bar 20.

In one example, shown in FIGS. 1 and 2, the handle bar 20 comprises a handle bar component configured in an arcuate or "U" shape. In this example, each leg of the "U" shape handle bar component is oriented near the handle bar axis 26 and the curved portion of the handle bar component is intended to provide gripping positions for a user.

In another example, the handle bar 20 comprises two handle bar components. In this example, a handle bar component is provided on each side of the seat. A grip is provided at one end of each handle bar component while the opposite end of each handle bar component is oriented near the handle bar axis 26.

The configuration of the mechanical components comprising the rotatable attachment between the handle bar 20 and the swing arm 16 is not limited and may comprise any such configuration known in the art, some of which have been described above.

In another embodiment, a rotation of the handle bar 20 about the handle bar axis 26 may cause a rotation of the back rest 18 about the back rest axis 24. In one example, the handle bar 20 includes an actuator 50 configured to contact the back rest 18. The handle bar axis 26 is oriented further from the seat 12 than the back rest axis 24.

One example of an actuator 50, shown in FIGS. 1 and 3, is a rotary bearing 52 provided at a distal end of an actuator arm 54. An outer diametral component 74 of the rotary bearing 52 is configured to contact, and roll along, the back rest 18. An inner diametral component 76 of the rotational bearing is coupled to the distal end of the actuator arm 54. An opposite end of the actuator arm 54 is attached to the handle bar 20. The actuator arm 54 may be adjustably attached to the handle bar 20 near the handle bar axis 26.

Thus, as the handle bar 20 is rotated forward, towards the feet of the user, the actuator 50 contacts the back rest 18, causing a rotation of the back rest 18 into a more upright position. Correspondingly, when the user leans back on the back rest 18, the back rest 18 acts on the actuator 50 to rotate the handle bar 20 away from the feet of the user.

The actuator 50 attached to the handle bar 20 may be configured to contact a back rest track 56 attached to the back rest 18. The back rest track 56 is formed on a side of the back rest 18 opposite the user contact surface 46 thereof. The back rest track 56 may be straight or may be provided with a more complex or curved profile. In one example, a back rest track 56 is oriented such that it generally bisects the back rest 18. Additionally, the back rest track 56 may be provided on a surface of a back rest pillar 48, as shown in FIG. 3.

In another example, also shown in FIG. 3, the surface of the back rest track 56 configured to be in contact with the actuator 50 attached to the handle bar 20 may be provided with a concave profile. The concave profile may be configured to prevent the actuator 50 from departing from the back rest track 56. The actuator 50 may be configured with a convex profile complementary to the concave profile of the back rest, also shown in FIG. 3. In a similar example, the back rest guide track 56 may be provided with a convex profile and the actuator 50 may be provided with a concave profile. In yet another similar example, either the back rest track 56 or the actuator 50 may be provided with guide flanges or another similar feature to prevent the actuator 50 from deviating from the back rest track 56.

In one example, shown in FIGS. 1 and 2, the handle bar 20 is configured to lie in substantially one plane, referred to herein as the "handle bar plane". In a case that the handle bar 20 does not exist in substantially the same plane, the handle bar plane may be defined as a plane intersecting the handle bar axis 26 and the gripping positions on the handle bar 20 or handle bar components. In the forgoing examples, the actuator 50 may be adjustably attached to the handle bar 20 in such a way that the angular relationship between the handle bar plane and the back rest plane 46 through a predetermined range of angles may be adjusted.

As one example of such an actuator 50 adjusting feature, the angle between an actuator arm 54 and the handle bar plane may be adjusted. For example, the actuator 50 may be provided with a tubular portion oriented with its main axis substantially coaxial with the handle bar axis 26. A handle bar component may be provided with end portions which engage outer ends of the tubular portion attached to the actuator 50 is such a way so as to allow rotation of the actuator 50 about the handle bar component. Both the handle bar component and the tubular portion of the actuator 50 may then be provided with a plurality of holes which align to each other at predetermined angles of relative rotation. Thus, a fixing pin may be inserted through corresponding holes to define the inclination angle of the actuator 50 relative to the handle bar component and, thus, the handle bar plane.

Accordingly, the relationship between the gripping positions of the handle bar 20 and the back rest plane 46 may be adjusted by altering the angle of inclination of the actuator 50 relative to the handle bar plane. For example, with the actuator 50 configured to incline at a first predetermined angle from the handle bar plane, the gripping positions of the handle bar may be configured to exist in the back rest plane 46 when the back rest plane is inclined at a negative angle such that users' heads are closer to the ground than their hips. In the same example, but with the actuator 50 adjusted to incline at a second predetermined angle, greater than the first predetermined angle from the handle bar plane, the gripping positions of the handle bar 20 may be configured to exist in the back rest plane 46 when the back rest plane 46 is inclined at a positive angle, such that users' hips are closer to the ground than their head. Consequently, the position of the gripping positions of the handle bar 20 relative to the back rest 18 when the back rest plane 46 is vertical, or perpendicular to the floor, are also consequently altered when the inclination angle of the actuator 50 is adjusted.

In yet another example, the handle bar 20 may include two or more actuators 50. In this example, the back rest 18 may include a complementary number of back rest tracks 56.

In still another example, the abdominal exercise apparatus 10 may comprise two handle bar components, each able to rotate about the handle bar axis 26 independently. In this example, an actuator 50 may be configured to be forced into a more upright position by the more upright handle bar component, the less upright handle bar component, or by some element configured to force the actuator 50 according to a combined position of the handle bar components. As another example, each independent handle bar component may be provided with an actuator 50.

In any of the above examples, the swing bar 16 or handle bar 20 may be provided with a handle bar rotation limiting element configured to limit the rotation of the handle bar 20 to a predetermined angular range relative to the swing bar 16. As one example, a pin may be provided near the handle bar axis 26 on the swing bar 16 which is configured to contact an actuator arm 54 when the actuator arm 54, and by extension the handle bar 20, reaches a predetermined inclination angle. Thus, the maximum inclination angle of the back rest 18 may also be limited by the handle bar rotation limiting element. As discussed above, the angle at which further rotation of the handle bar 20 or back rest 18 is stopped may be adjusted according to a user's desires. It will be appreciated that the a back rest rotation limiting element may be provided which may perform the same functions as the handle bar rotation limiting element in addition to, or in lieu of the handle bar rotation limiting element.

In order to store the abdominal exercise apparatus 10 more conveniently, features may be added to the abdominal exercise apparatus 10 which allow the apparatus to fold or collapse into a more convenient storage position different from an operating position.

In one example, the frame 14 may be provided with one or more collapsing hinges. For example, a hinge may be provided at each end of the seat 12. A first hinge, held in an operating or storage position by a fixing pin, may be provided at an end of the frame 14 towards the first frame stabilizing member 34. A similar second hinge may be provided at an opposite end of the seat 12 on the frame 16, closer to the second frame stabilizing member 36. Thus, when both hinges are positioned in their respective collapsed positions, the first 34 and second 36 frame stabilizing members, along with corresponding portions of the frame 14, may be collapsed into a more compact form, enabling more convenient transportation and storage of the apparatus 10.

In addition, in any of the examples described in this disclosure, it will be recognized that a friction reducing or increasing member or means may be provided at any of the rotation axes 22, 24 or 26 to add or reduce resistance to a user's movements. Such means or member may additionally be configurable by a user in order to increase or decrease the level of effort required in order to use the abdominal exercise apparatus 10, thus enabling customization of the apparatus 10 to a user.

In one exemplary method for using an abdominal exercise apparatus 10 of the type described above, a user first sits on the seat 12 of the apparatus. The user lays their back against the back rest 18 and grips the handle bar 20. The user twists their torso about their hips, causing a rotation of the swing bar 16 relative to the frame 14 about the swing bar axis 22. The user may rotate the handle bar 20 about the handle bar axis 26 to cause the back rest 18 to rotate about the back rest axis 24.

The rotation of the handle bar 20 relative to the swing bar 16 may be performed before or after the twisting of the user's torso which causes a rotation of the swing bar 16 about the frame 14.

One may keep their back laid against the back rest 18 while twisting their torso to rotate the swing bar 16 about the swing bar axis 22 and/or while rotating the handle bar 20 to further isolate muscles desired to be exercised. In a further example, the user's shoulders and upper back are controlled not to rotate about their head or spine during any of the exercise steps.

Using various methodologies and apparatuses described herein, muscle development, toning and strengthening in oblique and lateral abdominal muscles may be accomplished while helping to reduce spinal twisting and other movements superfluous to the contraction of the targeted muscles.

In addition, the embodiments and examples above are illustrative, and many variations can be introduced on them without departing from the spirit of the disclosure or from the scope of the appended claims. For example, elements and/or features of different illustrative and exemplary embodiments herein may be combined with each other and/or substituted for each other within the scope of this disclosure.

What is claimed is:

1. An abdominal exercise apparatus comprising:

a frame;

a seat attached to the frame;

a swing bar rotatably attached to the frame such that the swing bar is rotatable relative to the frame about a swing bar axis;

a back rest rotatably attached to the swing bar about a back rest axis which is substantially perpendicular to the swing bar axis; and a handle bar rotatably attached to the swing bar about a handle bar axis which is substantially parallel to the back rest axis.

2. The abdominal exercise apparatus of claim 1, wherein a rotation of the handle bar about the handle bar axis causes a rotation of the back rest about the back rest axis.

3. The abdominal exercise apparatus of claim 1, wherein the swing bar axis is oriented substantially parallel to a direction of gravity.

4. The abdominal exercise apparatus of claim 1, further comprising a pair of swing bar rotation stops attached to at least one of the frame and the swing bar, the swing bar rotation stops being configured to limit rotation of the swing bar about the swing bar axis to a predefined range of angles.

5. The abdominal exercise apparatus of claim 1, wherein the swing bar further comprises an auxiliary support element configured to contact the frame so as to at least partially transfer force applied to the swing bar to the frame at a location other than the swing bar axis.

6. The abdominal exercise apparatus of claim 5, further comprising a pair of swing bar rotation stops connected to each other by a web, the web being attached to the frame and the swing bar rotation stops being configured to limit rotation of the swing bar about the swing bar axis to a predefined range of angles, wherein the auxiliary support element is configured to contact a portion of the web.

7. The abdominal exercise apparatus of claim 1, wherein the frame includes a central frame element generally bisecting the seat and the swing bar axis intersects the central frame element beyond one end of the seat.

8. The abdominal exercise apparatus of claim 1, wherein the back rest axis is oriented on an opposite side of the swing bar axis from the seat and the handle bar axis is located farther from the swing bar axis than the back rest axis.

9. The abdominal exercise apparatus of claim 1, wherein the back rest axis intersects the swing bar axis.

10. A method for performing an abdominal exercise by a user comprising the steps of the user:

sitting on a seat attached to a frame of an abdominal exercise apparatus;

laying at least the user's back against a back rest, the back rest being rotatably attached to a swing bar about a back rest axis, the swing bar being rotatably attached to the frame about a swing bar axis oriented substantially perpendicular to the back rest axis;

gripping a handle bar, the handle bar being rotatably attached to the swing bar at a handle bar axis, the handle bar axis being parallel to the back rest pivot axis;

twisting the user's torso about the user's hips to cause a rotation of the swing bar relative to the frame about the swing bar axis; and rotating the handle bar about the handle bar axis to cause a rotation of the back rest about the back rest axis.

11. The method of claim 10, wherein the rotating step is performed after the twisting step.

12. The method of claim 10, wherein the twisting step further includes causing the swing bar to rotate about the swing bar axis until a swing bar rotation stop attached to one of the swing bar and the frame restricts further rotation of the swing bar about the swing bar axis.

13. The method of claim 10, wherein the swing bar axis is located at an end of the seat furthest from the user's feet.

14. The method of claim 10, wherein the twisting of the user's torso is in a direction substantially parallel to a direction of gravity.

15. The method of claim 10, wherein the twisting step is performed after the laying step and the user's back remains laid against the back rest during the twisting step.

16. The method of claim 10, wherein the user's shoulders and upper back do not twist about the user's head or spine during any of said sitting, laying, gripping, twisting or rotating steps.

* * * * *